United States Patent [19]

Graves, Jr.

[11] Patent Number: 4,754,767

[45] Date of Patent: Jul. 5, 1988

[54] TOBACCO MATERIAL PROCESSING

[75] Inventor: William H. Graves, Jr., Pfafftown, N.C.

[73] Assignee: R. J. Reynolds Tobacco Company, Winston-Salem, N.C.

[21] Appl. No.: 933,498

[22] Filed: Nov. 21, 1986

[51] Int. Cl.[4] ..... A24B 3/14

[52] U.S. Cl. ..... 131/370; 131/353; 131/375

[58] Field of Search ..... 131/370, 375, 353, 374

[56] References Cited

U.S. PATENT DOCUMENTS 3,076,729 2/1963 Garbo .
3,136,321 6/1964 David .
3,203,432 8/1965 Green et al. .
3,409,026 11/1968 Hind et al. .
3,499,454 3/1970 Hind .
4,347,855 9/1982 Lanzillotti et al. .
4,391,285 7/1983 Burnett et al. .
4,421,126 12/1983 Gellatly .
4,510,950 4/1985 Keritsis et al. .
4,625,737 12/1986 Keritsis et al. .
4,646,764 3/1987 Young et al. .

FOREIGN PATENT DOCUMENTS 1532042 12/1977 Fed. Rep. of Germany .

*Primary Examiner*—V. Millin

[57] ABSTRACT

Tobacco material can be processed to yield a product (e.g., sheet-like material) which can be used to yield cut filler for the manufacture of cigarettes. Tobacco material (e.g., whole leaf and/or scrap) is shear agitated in the presence of moisture of less than 30 weight percent. The shear agitation is performed in the absence of externally added binding agents. The sheared mixture is passed through a roller system in order to provide compressive treatment to the mixture. The processed mixture is further formed into the desired shape. Tobacco material can be provided using energy efficient processing steps, and without waste of tobacco material.

26 Claims, 2 Drawing Sheets

TOBACCO MATERIAL PROCESSING

BACKGROUND OF THE INVENTION

The present invention relates to the processing of tobacco leaf and other tobacco materials, and in particular to the processing of tobacco for the manufacture of smoking articles such as cigarettes.

Cured tobacco leaf conventionally undergoes several processing steps prior to the time that the resulting cut filler is provided. For example, tobacco leaves are threshed in order to separate the tobacco laminae from the stem. The tobacco laminae undergo further processing resulting in cut filler, while the stems are discarded or employed in the manufacture of reclaimed tobacco products which are traditionally of relatively low quality.

The handling, threshing and storing stages of conventional tobacco leaf processing steps result in the formation of considerable amounts of wasted tobacco material. In particular, typical processing conditions cause the formation of relatively large amounts of dust and fines. Such dust and fines are of such a small size as to be of essentially no use in the manufacture of cigarettes. However, it is possible to retrieve some of the dust and fines, and employ these materials with tobacco stems in the manufacture of reclaimed tobacco materials.

It would be highly desirable to provide an efficient process for providing processed tobacco material in the form of cut filler whereby all of the tobacco leaf can be employed and essentially no waste of the cured tobacco leaf is recognized.

SUMMARY OF THE INVENTION

In one aspect, the present invention is a process for providing processed tobacco material, the process comprising:

(a) providing tobacco material in divided form;

(b) subjecting the tobacco material to high shear agitation (i) essentially in the absence of binding agent additives, (ii) in the presence of sufficient moisture to provide for activation of the natural binding materials of the tobacco material but in the presence of a moisture content of less than 30 percent by weight, and (iii) for a period of time sufficient to provide for activation of the natural binding materials of the tobacco material; and then (c) subjecting the tobacco material so subjected to high shear agitation to compressive treatment by passing the tobacco material, at least once, through the nip of a roller system; and then (d) forming sheet-like processed tobacco material from the tobacco material which has been passed through the aforementioned roller system.

In another aspect, the present invention is a process for providing processed tobacco material, the process comprising:

(a) providing tobacco material in essentially whole leaf form;

(b) subjecting the tobacco material to high shear agitation (i) including a size reduction action in an amount sufficient to provide divided tobacco material, (ii) essentially in the absence of binding agent additives, (iii) in the presence of sufficient moisture to provide for activation of the natural binding materials of the tobacco material but in the presence of a moisture content of less than 30 percent by weight, and (iv) for a period of time sufficient to provide for activation of the natural binding materials of the tobacco material; and then (c) subjecting the tobacco material so subjected to high shear agitation to compressive treatment by passing the tobacco material, at least once, through the nip of a roller system, and then;

(d) forming sheet-like processed tobacco material from the tobacco material which has been passed through the aforementioned roller system.

Preferably, the size reduction action is a cutting action which is most preferably provided by a high shear slicing, shredding or chopping device, such as a Hobart HMC-450 Mixer. The divided material so provided includes individual particles of a size small enough to be processed using the roller system. For example, when tobacco leaf stems are included in any manner in the processing steps, portions of stems of the divided material have lengths of less than about 1.5 inch.

Preferably, the roller system is a pressurized roller system wherein there is provided a relatively great amount of compressive strength between the roller faces. In such a manner, the tobacco material can be efficiently and effectively worked into a material having a sheet-like shape and consistency. More preferably, the moist tobacco material which has been subjected to high shear agitation is passed, at least once, through the nip of a pressurized roller system having two rollers exhibiting a nip zone pressure sufficient to provide compression of the tobacco material, wherein (i) at least one of the roller faces comprises a series of grooves, the series extending longitudinally along the roller and each groove extending about the periphery of the roller, and (ii) each groove has a maximum width near the surface of the roller and a minimum width near the bottom of the groove. Most preferably, one of the roller faces of the pressurized roller system has the aforementioned series of grooves.

In a preferred aspect of the present invention, a desired amount of casing and/or top dressing is incorporated into the tobacco material at about that time that the tobacco material is subjected to the high shear agitation.

This invention allows for the reclamation and/or processing of tobacco in an efficient and effective manner using a process which requires neither relatively large amounts of moisture nor the necessity of the addition of binders. In fact, the process of this invention can be performed in the absence of virtually any binding agent additives. The process of this invention can be performed at or near ambient temperatures without the necessity of the application of external heat. If desired, the process of this invention can be performed without chemical pretreatment of the tobacco material.

The resulting processed tobacco material can be employed as is known in the art. For example, the processed tobacco material most preferably is provided in sheet-like form. The material so provided can be dried or moistened, treated with additives, blended with other tobacco materials, cut to the desired size, etc. The resulting tobacco material is most useful as cut filler in the manufacture of cigarettes.

DETAILED DESCRIPTION OF THE EMBODIMENTS

Figure 1:
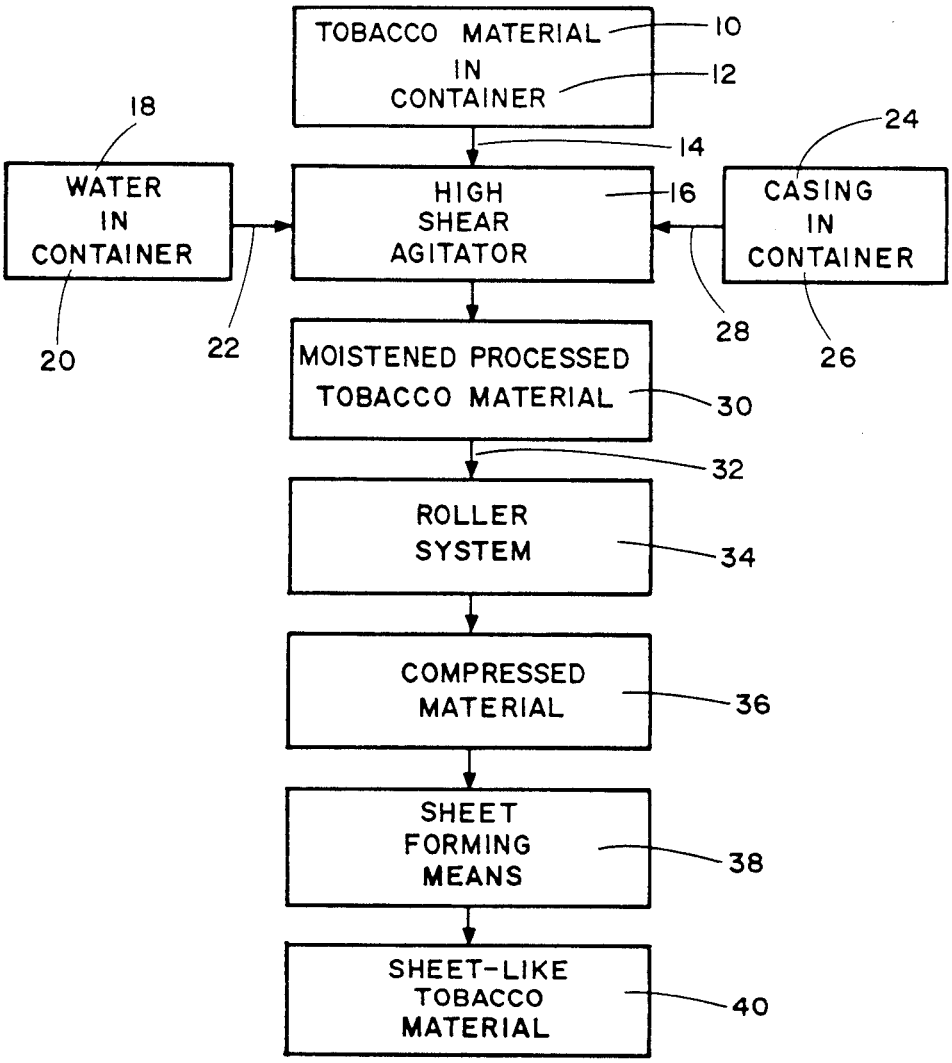
FIG. 1 is a schematic diagram of one preferred embodiment of the processing steps of this invention.

Referring to FIG. 1, tobacco material 10 is contained in a container 11 such as a storage bin, crate, vessel, hopper, or the like. Tobacco material 10 is transferred from the container 12 by conveying means 14 to high shear agitator 16. The conveying means 14 can be a conveyer belt, a transfer line, a simple pouring or dumping device, a volumetric feeder, or the like. The tobacco material 10 is subjected to high shear agitation in the presence of moisture, and optionally casing and top dressing. The moisture is provided in the form of water 18 which is contained in container 20. The water 18 is transferred from container 20 by conveying means 22 such as a sprayer, a transfer line, a simple pouring or dumping device, or the like. Casing and top dressing 24 is transferred from container 26 by a conveying means 28. Generally, the casing and top dressing are added to the high shear agitator as separate feeds or streams. The mixture is subjected to high shear agitation. The moisture and processed tobacco material 30 which has been subjected to high shear agitation is transferred from the high shear agitator 16 by transfer means 32 to roller system 34, and is passed through the roller system to provide compression of the moistened tobacco material. The resulting compressed material 36 is passed through a sheet forming means 38 and a sheet-like material 40 is obtained. Preferably, the sheet forming means 38 is a roller system.

The tobacco material useful in this invention can vary. Typically, the tobacco material can include tobacco fines, tobacco laminae, tobacco cut filler scrap tobacco which is recovered from various processing stages and cigarette manufacture stages, tobacco leaf stems, tobacco stems and stalks, rolled tobacco stems, scraps and/or sheets of wet formed reconstituted tobacco (for example in dry form), scraps and/or sheets of dry formed reconstituted tobacco, and the like, as well as combinations thereof and combinations thereof with tobacco dust. The sizes of the various pieces and particles of tobacco material are not particularly critical.

Tobacco material can be provided in essentially whole leaf form. By the term "essentially whole leaf form" is meant the entire leaf including the stem. Tobacco material is essentially whole leaf form includes cured tobacco provided from prize houses; and aged tobacco provided from bales, hogsheads and boxes. In particular, the total leaf including stem can be employed without throwing away any portion thereof. It is possible that portions of the tobacco leaf can be broken into pieces prior to the processing steps of this invention, however, such breakage need not be done purposefully as is common in conventional tobacco leaf processing. Preferably, tobacco material in essentially whole leaf form includes tobacco which is not threshed or destemmed. However, it may be desirable to clean or de-sand tobacco leaf using a screening technique or the like, prior to the processing steps of this invention. If desired, essentially all of the tobacco material which is processed according to this invention can be in essentially whole leaf form Types of tobaccos which can be processed according to this invention include burley, flue-cured, Maryland and oriental tobaccos. Types of tobaccos can be processed separately, or as blends thereof.

By the term "divided tobacco material" is meant tobacco material in essentially whole leaf form, large size laminae or whole stem which has been subjected to a size reduction action using equipment capable of forming smaller sized particles or pieces of tobacco material. Preferably, size reduction action includes a cutting action including chopping, tearing, slicing or shredding. Preferably, divided tobacco material exhibits a size capable of being processed further using the roller systems used in this invention. Typically, the laminae portion of the tobacco leaf can be cut or shredded to a size ranging from a small size approximating that of tobacco dust to relatively large pieces of leaf having lengths and widths of up to about 2 inches, respectively. Typically, portions of stems are milled, cut or shredded to sizes smaller than about 1.5 inch in length, preferably to a size wherein a majority of the stem material exhibits a length in the range from about 0.25 inch to about 1 inch. An example of high shear agitation means for providing divided tobacco material is a device having high speed rotating blades such as a commercially available Hobart HMC-450 Mixer. Generally, cutting or shredding occurs at ambient temperatures. Generally, shearing action for longer periods of time provides smaller sized divided tobacco material. However, the individual pieces of such divided tobacco material most preferably are larger than the powdered materials provided by grinding processes such as those processes incorporating ball mills.

As used herein, the term "high shear agitation" is meant to include that agitation which is sufficiently high in order to provide activation of the natural binding materials of the tobacco material (i) during a relatively short period of time, (ii) without the necessity of applying external heat in order to subject the moist tobacco material to temperatures significantly greater than ambient temperature, and (iii) without the necessity of subjecting the tobacco material to a moisture content greater than about 30 weight percent. Typical high shear agitation rates exceed about 1,000 rpm, and preferably exceed about 3,000 rpm as determined for a commercially available Hobart HMC-450 Mixer. The high rate of shear agitation can provide very rapid movement of the shearing means such as knives, blades, propellers, paddles, or the like. The time period over which the moist tobacco material is subjected to the high rate of shear agitation can vary and can be as long as desired. Typically, the time period is less than about 15 minutes, preferably less than about 10 minutes, more preferably between about 3 minutes and about 6 minutes.

The high rate of shear agitation is believed to provide a breakdown of the individual particles and fibers of tobacco material. Such a breakdown is believed to provide a separation of some of the natural binding materials from the particles and fibers. In addition, it is believed that the shearing action brings out the inherent binding properties of the binding materials and makes those natural binding materials available for binding action. Thus, certain of the natural binding materials of the tobacco material exhibit binding properties for binding the various individual particles and pieces of tobacco. The natural binding materials can provide a binding action to the tobacco material in order to provide the resulting product.

The high rate of shear agitation is believed to be capable of providing a separation of the natural binding materials from the various tobacco parts or pieces, a mixing of materials, a coalescence and agglomeration of materials, and at least some activation of the binding materials.

The moist tobacco material subjected to high shear agitation generally exhibits a generally softened, somewhat formable or consistent character, and can be somewhat tacky in nature.

As used herein, the phrase "essentially in the absence of binding agent additives" is meant that no binding agent additives are purposefully added during the processing step. As used, the phrase is meant to include the virtual absence of externally added binding agent additives as well as small amounts (e.g., less than 1 percent based on the weight of tobacco material) which may be present as impurities or the like.

The moisture content of the tobacco material during high shear agitation can vary. Typically, a low moisture content requires a relatively greater amount of force in order to ultimately provide processed tobacco materials; while a high moisture content requires the undesirable and energy intensive drying processes attendant in conventional water based reconstituted tobacco processes. Typically, the tobacco material which is processed herein exhibits a moisture content of at least about 12 weight percent, preferably at least about 18 weight percent, more preferably at least about 20 weight percent; while the upper limit is less than about 30 weight percent, preferably less than about 25 weight percent. It is believed that the moisture imports a softening of the tobacco material, as well as providing a pliability sufficient to allow for some initial activation of the natural binding materials. It is desirable that the moisture content not be overly high as to require excessive drying of the resulting sheet-like material, or to cause an undesirable pliability of tobacco material or a resulting sheet-like material of relatively poor tensile strength.

As used herein the term "activation" in referring to the natural binding materials is meant to include the introduction of the latent adhesive properties of natural binding materials to make those binding materials available for providing a binding action for adhering the various particles or pieces of tobacco material together. The introduction of adhesive properties can be provided by the application of shear energy and moisture, as discussed hereinbefore, as well as by the application of heat, pressure, or the like.

High rates of shear agitation can be provided using an apparatus such as a high intensity mixer, a homogenizer, a blender, or other high shear device. For example, from about 50 g to about 300 g of tobacco material can be subjected to high shear mixing using a commercially available Waring Blender set at medium speed for about 5 minutes or high speed for about 3 minutes, while periodically scrapping the sides of the mixing container with a device such as spatula in order to minimize cavitation of tobacco material and promote adequate thorough mixing. As another example, from about 1 kg to about 7 kg of tobacco material can be subjected to high shear mixing using a commercially available Hobart HMC-450 Mixer having the timer set at high speed for about 5 minutes.

The process of this invention provides an efficient and effective means for incorporating water and/or temperature sensitive flavorants into the tobacco extender product. For example, certain flavorants such as tobacco extracts, vanillin, chocolate, licorice, and the like can be blended with the tobacco material. As the process of this invention can be performed at ambient temperatures the desirable characteristics of the flavorants are not lost due to degradation or chemical transformation caused by high temperatures. In addition, as the process of this invention is performed using relatively low moisture levels and relatively low amounts of liquid water are removed from the processed tobacco material, only relatively small amounts of moisture sensitive and/or water soluble flavorants are lost during processing stages.

Figure 3:
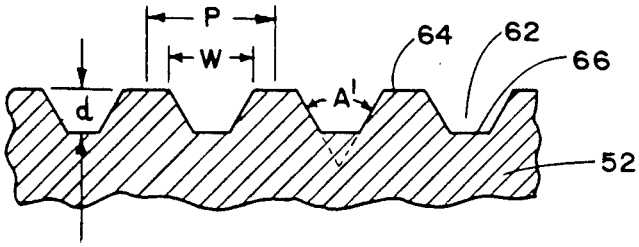
FIG. 3 is an enlarged, partial sectional view of one roller in FIG. 2 and showing a series of grooves, each groove extending circumferentially about the periphery of the roller.
Figure 2:
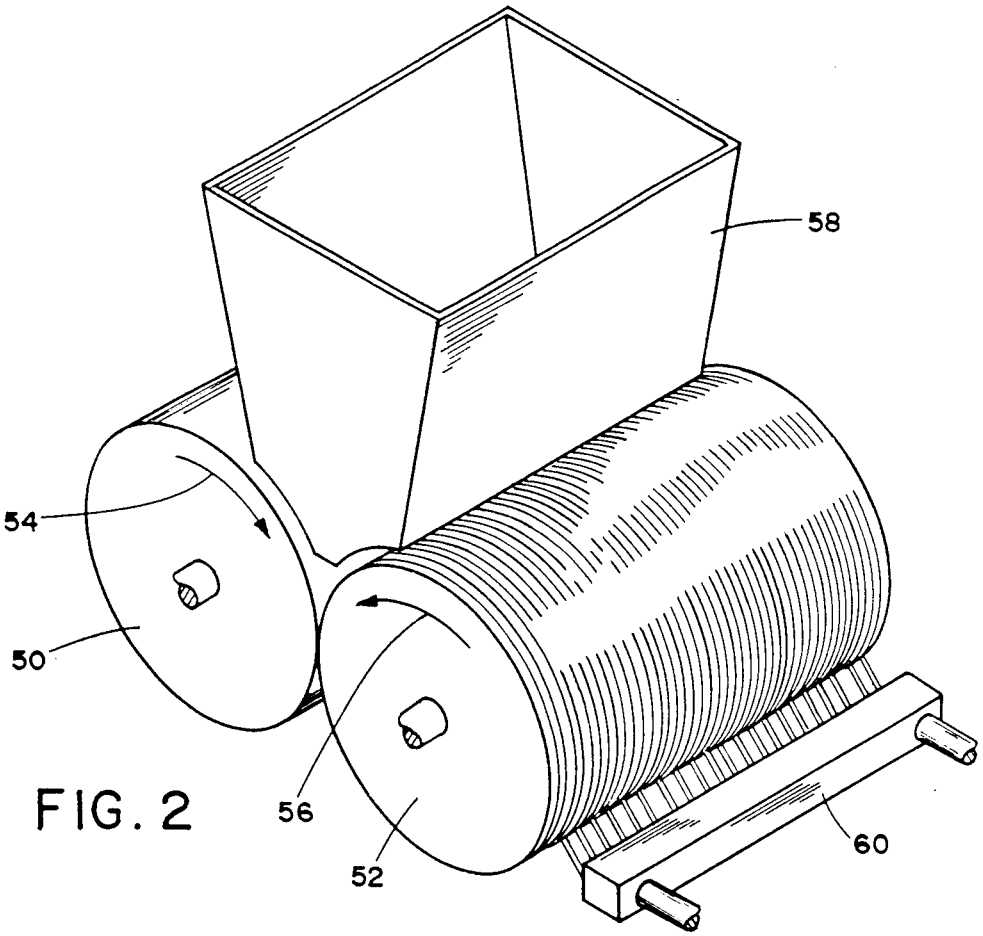
FIG. 2 is a perspective of an apparatus useful in a portion of the process of this invention.

FIGS. 2 and 3 illustrate an apparatus for conducting a portion of the process of this invention. The apparatus is particularly useful for providing a compressed and formed material from the moist tobacco material which have been subjected to the high shear agitation. The apparatus has a pressurized roller system. As used herein, the term "pressurized roller system" means two rollers in roll contact and exhibiting a nip zone pressure sufficient to provide compression of the moist tobacco material which passes therethrough into a more compressed form. The apparatus includes roller 50 and roller 52 in roll contact with one another. By the term, "roll contact" is meant that the two rollers aligned with roll faces essentially parallel to each other have the roll faces thereof in contact with one another for a distance along the length of each roller, and wherein each roller is capable of being rotated about the longitudinal axis of each roller. Each of rollers 50 and 52 are mounted such that the aforementioned roll contact is substantially maintained during the time that the moist tobacco material is passed through the nip of the roller system. Force is applied to each of the rollers using hydraulic cylinders, hydraulic pumps, compression springs, tension springs, compression rollers equipped with jack screws, or the like. Each of rollers 50 and 52 are rotated in the direction indicated by arrows 54 and 56 within the rollers. The rollers are rotated in opposite directions relative to one another in order that the moist tobacco material is passed through the nip of the rollers. Each of the rollers are driven using a power source (not shown) such as a variable speed motor (e.g., an electric motor capable of generating from about 0.5 to about 5 horsepower) which turns the rollers by a series of drive gears (not shown). The rollers are supported to a support means such as a frame (not shown) to a chassis (not shown).

For the embodiment shown roller 50 has a substantially smooth (i.e., non-grooved) roller face; and roller 52 contains a series of grooves therein. The series extends longitudinally along the roller 52, and each groove extends about the periphery of the roller. Roller 52 is referred to as a "grooved roller."

The faces between the rollers which typically required in the process of this invention can vary, but is that force which is great enough to generate sufficient roller nip zone pressures in order to provide or form ultimately well mixed, compressed tobacco materials. That is, sufficient nip zone pressures are those sufficient to provide shearing, mixing, and forming of the moist tobacco material, and can be as great as is desired. Typically, forces between rollers of at least about 400, and as much as about 3,000, preferably about 600 to 1,500, pounds per linear inch, are great enough to generate sufficient nip zone pressures. Typically, the rollers are constructed of a metal material such as hardened carbon steel or hardened alloy steel, or other material sufficient to withstand the compression.

The sizes of the rollers can vary. Typically roller diameters range from about 3 inches to about 36 inches, preferably about 6 inches to about 8 inches; while roller lengths range from about 4 inches to about 24 inches. The diameters of the two rollers forming the roller system can be equal, or the diameters can differ. Typical rotation roller speeds range from about 10 rpm to about 270 rpm.

Operation of the apparatus involves feeding the moist tobacco material by hopper 58 into the feed zone or nip zone of the rollers 50 and 52. The moist tobacco material passes through the pressurized roller system, and is mixed and performed into a macerated and compressed tobacco material having some characteristics of sheet-like tobacco material. The tobacco material exiting the roller system can have a tendency to stick to the rollers, and the material can be removed from the roller face (particularly grooved roller 52) by scrape 60. Scrape 60 can be a series of needles, a comb-like configuration, a corrugated metal sheet, metal finger-like materials, or a knife-like means such as a doctor blade, positioned against the face of the roller so as to remove (i.e., scrape) the tobacco material from the face of the roller.

FIG. 3 illustrates a portion of roller 52. The series of grooves 62 are positioned along roller 52, and each groove has a top portion 64 (i.e., towards the outer surface of the roller face) and a bottom portion 66 (i.e., towards the inner portion of the roller). The grooved roller can provide shredding, tearing, forming, mixing or blending action to the tobacco material which is passed through the roller system. The series of grooves extends longitudinally along roller 52. Each groove completely circumscribes roller 52. Preferably, each groove has a shape substantially similar to the other grooves which extend along the roller. Preferably, the grooves each circumscribe the roller transversely relative to the longitudinal axis of the roller. Top portion 64 is flattened and typically ranges in width from about 0.010 inch to about 0.015 inch. Generally, the flattened top portion 64 is narrow enough so as to not require excessive force in order to maintain roller contact within the pressurized roller system; while flattened top portion 64 is wide enough as to not deform to a substantial extent under typical nip zone pressures. Bottom portion 66 can be rounded or flattened (as illustrated in FIG. 3). When flattened, bottom portion 66 typically ranges in width from about 0.003 inch to about 0.007 inch. Generally, bottom portion 66 is narrow enough so as to provide sufficient mixing action to the moist tobacco material Flattened bottom portion 66 is wide enough so as to permit the release of tobacco material from the surface region of the roller after processing. In particular, a bottom portion 66 which is overly narrow or pointed can tend to trap tobacco material in the groove and prevent release of the tobacco material therefrom. The depth d of the groove can vary and typically ranges from about 0.008 inch to about 0.025 inch. The depth is defined as the radial distance between the bottom portion of the groove and the top portion of the groove. The greatest width w of the groove can vary and typically ranges from about 0.015 inch to about 0.040 inch. The width is defined as the lateral distance measured across the groove. The pitch p of the groove can vary and depends upon a variety of factors including the type of tobacco material which is processed, the moisture content of the tobacco material, the shape of the groove, and the like. The pitch is defined as that lateral distance from the center of top portion 64 to the center of the nearest adjacent top portion 64. Typically, a pitch of about 0.02 inch (i.e., about 1/50 inch) to about 0.06 inch (i.e., about 1.16 inch); preferably about 0.03 inch (i.e., about 1.32 inch) is useful for most applications. The shape of groove 62 can vary and depends upon a variety of factors. However, each groove has a maximum width near the surface of the roller and a minimum width near the bottom of the groove. Each groove has sloped sides (i.e., non perpendicular to the roller face) and preferably each groove is generally "V" shaped. For example, pressurized roller system having a roller comprising a series of grooves each having a sloping inner edge each groove circumscribing an angle A′ of less than about 120°, can mix tobacco material suitably well; and a pressurized roller system having a roller comprising a series of grooves each having a sloping inner edge, each groove circumscribing an angle A′ of greater than about 60°, can release processed tobacco material suitably well. The preferred angle A′ ranges from about 60° to about 120°, and is most preferably about 90°.

Figure 4:
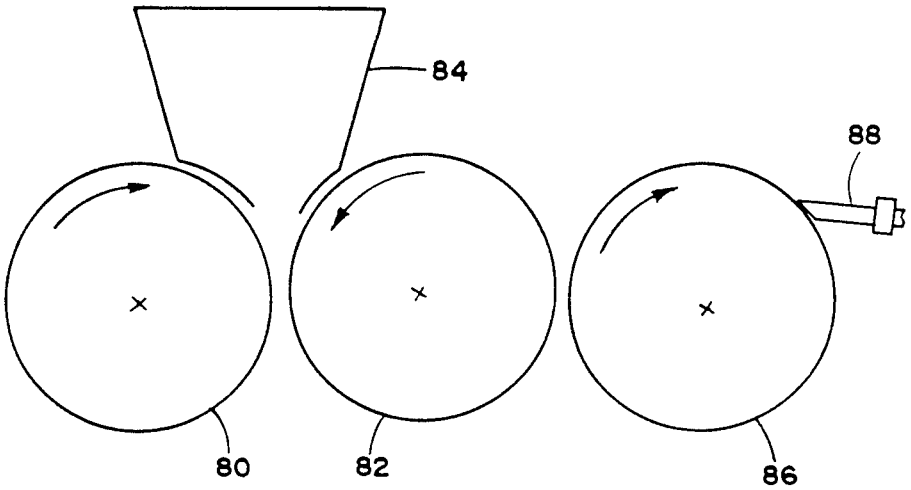
FIG. 4 is a diagrammatic illustration of an apparatus useful in a portion of the process of this invention showing three rollers which can provide sheet form processed tobacco material.

FIG. 4 illustrates an apparatus for conducting a portion of the process of this invention. The apparatus comprises 3 rollers in horizontal alignment and are positioned so as to have the ability to be moved out of roll contact. The 3 rollers typically have substantially smooth surfaces, and are constructed from materials as described hereinbefore. First roller 80 and second roller 82 are rotated in directions opposite to one another such that previously processed tobacco material fed in hopper 84 can pass through the nip thereof. Third roller 86 is rotated in a direction opposite to second roller 82 such that processed tobacco material passes through the nip thereof. Typically, first roller 80 is rotated at about 20 rpm to about 50 rpm; second roller 82 is rotated at a greater speed than the first roller; and third roller 86 is rotated at a greater speed than the second roller. The greater rotational speed of the second roller relative to the first roller provides the tendency for tobacco material to adhere to the second roller; and similarly the greater rotational speed of the third roller relative to the second roller provides the tendency for tobacco material to adhere to the third roller. Tobacco material in generally sheet-like form (e.g., as a sheet-like product) is removed from the surface of the third roller using scrape 88 which extends along the roller face thereof. The rollers are supported by a frame (not shown) and are rotated using a power source (not shown) and a series of drive gears (not shown).

The processed tobacco material which is provided according to the process of this invention can be provided generally in the form of a sheet. The sheet-like material exhibits good flexibility and tensile strength. Typically, the processed tobacco material in the form of a sheet exhibits a structural strength which approaches that of tobacco leaf. By the term "sheet" as used herein is meant that the tobacco material is in a form wherein the length and width thereof are substantially greater than the thickness thereof. Typically, the thickness of the sheet approximates that of tobacco leaf, cured or processed tobacco leaf, or wet reconstituted tobacco sheet product. For example, the thickness of the sheet can range from about 0.005 inch to about 0.040 inch, preferably from about 0.005 inch to about 0.015 inch. The length and width of the sheet or strip of processed tobacco material can vary. The width of the sheet generally is determined by factors such as the longitudinal distance which the rollers of the second pressurized roller system are in a spaced apart relationship, the length of the means for removing the processed tobacco material from the roller face of the rollers, and the like. The sheet-like material exhibits good flexibility and tensile strength. The sheet can be cut as are tobacco leaf or we formed reconstituted tobacco material (e.g., in strips of about 32 cuts per inch) using various cutting devices. The processed tobacco material can be cased, top dressed and treated with numerous flavorants, and employed as cut filler in the manufacture of cigarettes.

The following examples are provided in order to further illustrate various embodiments of the invention but should not be construed as limiting the scope thereof. Unless otherwise noted, all parts and percentages are by weight.

EXAMPLE 1

Sheet form tobacco material is provided using the following procedure.

Into a Hobart-HMC-450 high shear mixer equipped with stainless steel shaft and 2 stainless steel blades each having lengths of about 8 inches is placed about 1 to about 4 kg of a mixture of tobacco material. The mixture is 1 part Winnower Throw stems from a Molins MK 1X Cigarette Maker; 0.5 part Oriental tobacco total leaf; and 0.5 part flue-cured tobacco total leaf. The tobacco materials are obtained from tobaccos which have been cured and aged. Enough water is added to the mixer to provide tobacco material having a moisture content of 25 percent.

The tobacco material is subjected to high shear agitation by running the mixer at 3500 rpm for about 8 minutes. As mixing commences, to the mixer is added 1 percent glycerin top dressing and 10 percent water based casing.

The resulting moist tobacco material which has been subjected to high shear agitation is processed further by compressive treatment using the apparatus enerally illustrated in FIG. 10.

Roller 50 is constructed from hardened steel, has a smooth surface, and has a diameter of 6 inches and a roller face having a length of 4 inches. Roller 52 has a diameter of 6 inches and is of a similar length and construction to roller 50; however, roller 52 contains grooves extending in a radial fashion about the periphery thereof. Roller 52 contains grooves in a 4 inch distance longitudinally along the roller face. The grooved portion of the roller is generally illustrated in FIG. 4. The depth d of each groove is about 0.009 inch, the pitch p of each groove is about 0.03125 inch, and the angle A′ is about 60°. The top portion of each groove is flattened by a distance of about 0.008 inch, and the bottom of each groove is flattened by a distance of about 0.003 inch. The rollers both are rotated at about 35 rpm. The power source is a 1.5 horsepower electric motor having a geared drive system. Jack screws provide a pressure between the rollers of about 1,000 pounds per linear inch. The moist tobacco material is placed in hopper 58 of the apparatus, and the material is passed through the nip of rollers 50 and 52. The material so processed is collected and resembles a corrugated sheet.

The resulting compressed tobacco material is further processed using an apparatus generally illustrated in FIG. 4.

The apparatus is a roll mill sold commercially as Kent Model 4″×8″ Lab, High-Speed, 3 Roll Mill by Chas. Ross & Son Co., Hauppauge, N.Y., USA. The apparatus comprises 3 rollers each having an essentially smooth roll face. The rollers each have a longitudinal length of 8 inches and a diameter of 4 inches. The rollers are positioned in a horizontal position with their roll faces parallel to one another. The spacing between the roll faces is proportional to the pressure applied to the rollers and to the tobacco material passing through the nip area. The tobacco material which has been subjected to compressive treatment is transferred to the hopper which feeds said material to the zone between the first 2 rollers. The first roller is rotated at a roll speed of 30 rpm. The second roller is rotated at a roll speed of 3 times that of the first roller (i.e., 90 rpm). The material passes between the rollers and then passes between the second and third rollers. The third roller is rotated at roll speed of 3 times the second roller (i.e., 270 rpm). The processed tobacco material is collected from the third roller using a doctor blade positioned along the roll face of the third roller near the extreme vertical portion of the roller. The doctor blade is extended to provide a collection tray for the product. The nip zone pressure between rollers 80 and 82 is 200 pounds per linear inch; and the nip zone pressure between rollers 82 and 86 is from 300 to 400 pounds per linear inch.

The processed material is passed through the apparatus a second time. The nip zone pressure between rollers 80 and 82 is 300 to 400 pounds per linear inch; and the nip zone pressure between rollers 82 and 86 is 500 to 600 pounds per linear inch. The processed material product is a continuous sheet, about 8 inches in width and having a thickness between about 0.018 inch and about 0.035 inch.

EXAMPLE 2

Sheet form tobacco material is provided using the following procedure:

Into the Hobart-HMC-450 high shear mixer described in Example 1 is placed 2 kg of a mixture of tobacco material. The mixture is 1 part Turkish tobacco scrap, 1 part flue-cured tobacco scrap and 1 part tobacco dust. Enough water is added to the mixer to provide tobacco material having a moisture content of 22 percent.

The tobacco material is subjected to high shear agitation by running the mixer at 3,500 rpm for 6 minutes.

The resulting moist tobacco material which has been subjected to high shear agitation is processed further by compressive treatment using the apparatus enerally illustrated in FIG. 10 and described in Example 1.

The resulting compressed tobacco material is further processed to yield a sheet-like product. The compressed tobacco material is transferred to a vibrating hopper which feeds a twin screw extruder. The twin screw extruder comprises a constant pitch metal screw 16 inches long. The diameter of the screw is 1.5 inch and flights are positioned along the length of the screw at a 2 inch pitch. The twin screw extruder and roller system is a commercially available $TS_f$—10 Roll Press supplied by Material Processing Corporation, Amherst, Ill., USA. The compressed tobacco material is passed through the screw extruder which is run at about 4 to about 30 rpm using a 1.5 horsepower electric motor. The temperature within the barrel is stabilized at about 85° F. The tobacco material is passed from the extruder through a metal die having a rectangular die opening of 0.25 inch by 6 inch. The tobacco material which has been subjected to extrusion is fed from the die directly through the nip of two rollers which are in roll contact and form a pressurized roller system. The smooth faced rollers each are cylindrical and have a 6 inch diameter and a longitudinal length of 6 inches. The rollers are held in roll contact using jack screws, and a nip zone pressure of 1,600 pounds per linear inch is generated. The rollers are operated at roll speeds of 6 to 30 rpm.

Tobacco material in sheet form exits the pressurized roller system. Sheets are provided by scraping the processed material from the roller using a doctor blade which extends along the length of the roller face. The continuous sheet is about 6 inches wide, from 0.008 inch to 0.025 inch thick, and has the appearance of tobacco leaf.

EXAMPLE 3

Sheet form tobacco material is provided using the procedure generally described in Example 2. In one instance, the tobacco material which is processed is 2 kg of flue cured whole leaf. In another instance, the tobacco material which is processed is burley tobacco whole leaf. In another aspect, the tobacco material which is processed is 3 kg of Turkish tobacco scrap.

What is claimed is:

1. A process for providing processed tobacco material, the process comprising:

(a) providing tobacco material in divided form;

(b) subjecting the tobacco material to high shear agitation (i) essentially in the absence of binding agent additives, (ii) in the presence of a moisture content of at least about 12 percent by weight and sufficient moisture to provide for activation of the natural binding materials of the tobacco material but in the presence of a moisture content of less than 30 percent by weight, and (iii) for a period of time sufficient to provide for activation of the natural binding materials of the tobacco material; and then (c) subjecting the tobacco material so subjected to high shear agitation to compressive treatment by passing the tobacco material, at least once, through the nip of a roller system; and then (d) forming processed tobacco material from the tobacco material which has been passed through the aforementioned roller system.

2. The process of claim 1 wherein the processed tobacco material is provided in sheet-like form.

3. The process of claim 1 wherein the roller system is a pressurized roller system.

4. The process of claim 3 wherein said pressurized roller system includes two rollers exhibiting a nip zone pressure sufficient to provide compression of the tobacco material, wherein (i) at least one of the roller faces comprises a series of grooves, the series extending longitudinally along the roller and each groove extending about the periphery of the roller, and (ii) each groove has a maximum width near the surface of the roller and a minimum width near the bottom of the groove.

5. The process of claim 4 wherein each of said grooves is generally "V" shaped.

6. The process of claim 4 wherein each groove circumscribes the roller substantially transversely relative to the longitudinal axis of the roller.

7. The process of claim 3 wherein the nip zone pressure ranges from about 1,000 pounds per linear inch to about 10,000 pounds per linear inch.

8. The process of claim 1 wherein said tobacco material is subjected to high shear agitation in the presence of a moisture content of less than about 25 percent by weight.

9. The process of claim 1 wherein said tobacco material is subjected to high shear agitation in the presence of a moisture content between about 18 percent and about 25 percent by weight.

10. The process of claim 1 wherein said high shear agitation is provided for a period of about 5 minutes to about 1 kg to about 10 kg of tobacco material and moisture by a Hobart HMC-450 Mixer providing an agitation rate of greater than about 1,000 rpm.

11. The process of claim 1 wherein flavorant is incorporated into the divided material so subjected to high shear agitation prior to the farming of the processed tobacco material.

12. A process for providing processed tobacco material, the process comprising:

(a) providing tobacco material in essentially whole leaf form;

(b) subjecting the tobacco material to high shear agitation (i) including a size reduction action in an amount sufficient to provide divided tobacco material; (ii) essentially in the absence of binding agent additives; (iii) in the presence of a moisture content of at least about 12 percent by weight and sufficient moisture to provide for activation of the natural binding materials of the tobacco material but in the presence of a moisture content of less than 30 percent by weight, (iv) for a period of time sufficient to provide for activation of the natural binding materials of the tobacco material; and then (c) subjecting the tobacco material so subjected to high shear agitation to compressive treatment by passing the tobacco material, at least once, through the nip of a roller system, and then;

(d) forming sheet-like processed tobacco material from the tobacco material which has been passed through the aforementioned roller system.

13. The process of claim 12 wherein the processed tobacco material is provided in sheet-like form.

14. The process of claim 12 wherein the roller system is a pressurized roller system.

15. The process of claim 14 wherein said pressurized roller system includes two rollers exhibiting a nip zone pressure sufficient to provide compression of the tobacco material, wherein (i) at least one of the roller faces comprises a series of grooves, the series extending longitudinally along the roller and each groove extending about the periphery of the roller, and (ii) each groove has a maximum width near the surface of the roller and a minimum width near the bottom of the groove.

16. The process of claim 15 wherein each of said grooves is generally "V" shaped.

17. The process of claim 15 wherein each groove circumscribes the roller substantially transversely relative to the longitudinal axis of the roller.

18. The process of claim 14 wherein the nip zone pressure ranges from about 1,000 pounds per linear inch to about 10,000 pounds per linear inch.

19. The process of claim 12 wherein essentially all of the tobacco material is in essentially whole leaf form.

20. The process of claim 12 wherein said size reduction action is a cutting action.

21. The process of claim 20 wherein said cutting action is provided by a high shear shredding device.

22. The process of claim 12 wherein said tobacco material is subjected to high shear agitation in the presence of a moisture content between about 18 percent and about 25 percent by weight.

23. The process of claim 12 wherein said high shear agitation is provided for a period of about 5 minutes to about 1 kg to about 10 kg of tobacco material, and moisture by a Hobart HMC-450 Mixer providing an agitation rate of greater than about 1,000 rpm.

24. The process of claim 19 wherein the size reduction action provides portions of stems wherein the majority thereof exhibits a length in the range from about 0.25 inch to about 1 inch.

25. The process of claim 12 wherein flavorant is incorporated into the divided material so subjected to high shear agitation prior to the forming of the processed tobacco material.

26. The process of claim 13 wherein the forming of the sheet-like processed tobacco material is performed using a roller system.

* * * * *

UNITED STATES PATENT AND TRADEMARK OFFICE

CERTIFICATE OF CORRECTION

PATENT NO. : 4,754,767

DATED : July 5, 1988

INVENTOR(S) : William H. Graves, Jr.

It is certified that error appears in the above—identified patent and that said Letters Patent is hereby corrected as shown below:

In the Specification:

Column 9, line 44, please delete "enerally" and insert --generally--.

Column 10, line 55, please delete "enerally" and insert --generally--.

Column 12, line 22, please delete "farming" and insert --forming--.

Signed and Sealed this

Twenty-seventh Day of February, 1990

*Attest:*

JEFFREY M. SAMUELS

*Attesting Officer* *Acting Commissioner of Patents and Trademarks*